United States Patent [19]

Stahlecker et al.

[11] Patent Number: 5,014,398

[45] Date of Patent: May 14, 1991

[54] HIGH-DRAFT DRAFTING UNIT

[75] Inventors: Fritz Stahlecker, Josef-Neidhart-Str. 17, 7347 Bad Überkingen, FRG, Fed. Rep. of Germany; Hans Stahlecker, Haldenstrasse 20, 7334 Süssen, FRG, Fed. Rep. of Germany

[73] Assignees: Fritz Stahlecker, Fed. Rep. of Germany; Hans Stahlecker, Fed. Rep. of Germany

[21] Appl. No.: 483,749

[22] Filed: Feb. 23, 1990

[30] Foreign Application Priority Data

Feb. 25, 1989 [DE] Fed. Rep. of Germany ..... 3905941

[51] Int. Cl.[5] ..... D01H 5/70

[52] U.S. Cl. ..... 19/244

[58] Field of Search ..... 19/244, 252, 254; 57/315

[56] References Cited

U.S. PATENT DOCUMENTS 4,192,041 3/1980 Sasaki et al. ..... 19/244
4,718,225 1/1988 Sanagi ..... 19/244

FOREIGN PATENT DOCUMENTS 2278801 2/1976 France ..... 19/258
0110930 6/1985 Japan ..... 19/244

OTHER PUBLICATIONS

Drawing Number ASp 11 123, Edition; 2/73, SKF Kugellagerfabriken GmbH.

*Primary Examiner*—Werner H. Schroeder
*Assistant Examiner*—John J. Calvert
*Attorney, Agent, or Firm*—Evenson, Wands, Edwards, Lenahan & McKeown

[57] ABSTRACT

In a high-draft drafting unit for a spinning machine having several drafting zones which are each delimited by pairs of rollers, it is provided that the working width of the pairs of rollers in the travel direction of the silver is reduced in one or several steps.

23 Claims, 2 Drawing Sheets

HIGH-DRAFT DRAFTING UNIT

BACKGROUND & SUMMARY OF THE INVENTION

The invention relates to a high-draft drafting unit for a spinning machine having several drafting zones which are each delimited by two pairs of rollers formed of pressure rollers and bottom rollers and of which at least one is equipped with an apron guide containing a top apron and a bottom apron, the axial length of coverings of the pressure rollers and the apron width determining the working width of the pairs of rollers transversely to the travel direction of a sliver.

In the case of drafting units for spinning machines, the pressure rollers or top rollers are normally constructed to be identical so that, along the whole travel path through a drafting unit, essentially the same working width is obtained at each pair of rollers. Deviations may occur in the area of apron top rollers since the apron width is standardized. It may therefore happen that the top rollers of the aprons are held longer than the other top rollers so that unintentionally a larger working width will occur in the area of the apron guide than in the area of the feeding roller pairs and of the delivery roller pairs. For example, it is known from a sales manual of the firm SKF (Drawing Number ASp 11 123, Edition 2/73) to select, in the case of a drafting unit support with the designation PK 220, the feeding and delivery top rollers with a working width of 25 mm. The smallest width of an available apron (Drawing Number ASp 11 125, 1984), on the other hand, is 28 mm.

An object of the invention is to simplify a high-draft drafting unit of the initially mentioned type and thus reduce its costs.

This object is achieved in that the working width, in the travel direction of the sliver, is reduced in one or several steps by the fact that the axial length of the pressure rollers which follow and/or the apron width of the apron guide which follows is reduced in comparison to the preceding ones.

In this manner, an adaptation is obtained of the working width to the sliver which becomes finer as a result of the drafting. This results not only in the saving of materials with respect to the pressure rollers but also permits a higher specific loading along the respective nip line so that the overall loading of the pressure rollers may be reduced. With the same clamping effect as before, work can be carried out with a lower loading force. Weaker springs may be used while, in addition, the loading of the bearings is reduced. In addition, the power requirement of the drafting unit is reduced which is an important factor particularly in view of the high delivery speeds at the outlet of the high-draft drafting unit endeavored today.

Other objects, advantages and novel features of the present invention will become apparent from the following detailed description of the invention when considered in conjunction with the accompanying drawings.

DETAILED DESCRIPTION OF THE DRAWING

Figure 1:
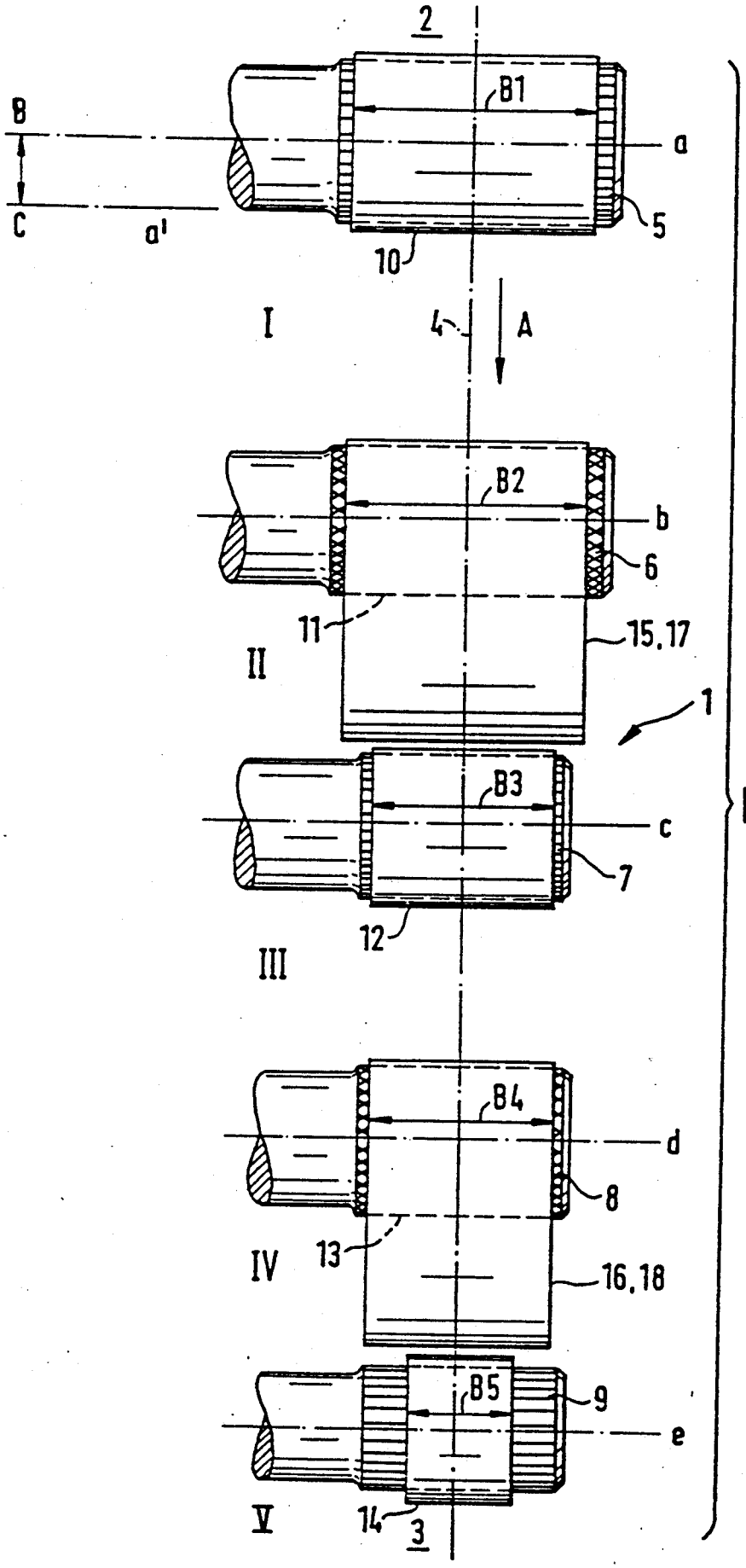
FIG. 1 is a schematic top view of a drafting unit constructed according to a referred embodiment of the invention.
Figure 2:
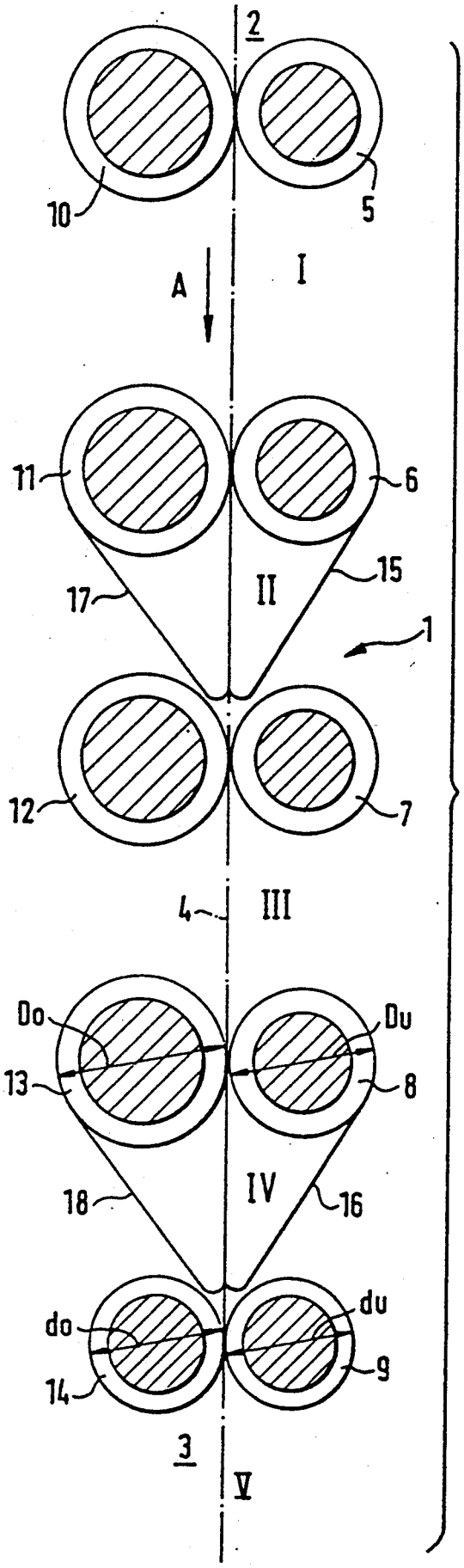
FIG. 2 is a lateral view of the drafting unit of FIG. 1.

The shown drafting unit 1 is constructed as a five-cylinder drafting unit, i.e., as a high-draft drafting unit. It has a feeding side 2 at which a sliver 4 is fed which is shown by a dash-dotted line and is to be drawn and which, after the drawing, is delivered on the delivery side 3 in the desired yarn size. The drafting unit 1 has five drivable bottom rollers 5, 6, 7, 8, 9. These may be cylinders extending through in the longitudinal direction of the machine and forming the bottom rollers of a plurality of drafting units of a spinning machine which are arranged next to one another. However, as shown in FIG. 1, they may also be shaft ends which are each assigned to only one drafting unit. Pressure rollers 10, 11, 12, 13, 14, also called top rollers, are assigned to the bottom rollers 5, 6, 7, 8, 9. On their outside, the pressure rollers 10, 11, 12, 13, 14 are provided with a covering of an elastic material which is constructed such that the outer surface can be ground. In a manner not shown in detail, these top rollers are received by a loading arm in which the bearings and holding elements as well as the loading elements are arranged by means of which the pressure rollers 10, 11, 12, 13, 14 are pressed against the pertaining bottom rollers 5, 6, 7, 8, 9 by means of a given contact pressure force. As a rule, the pressure rollers 10 to 14 are constructed as so-called pressure roller twins, i.e., two pressure rollers respectively of two adjacent drafting units are disposed on a common shaft held in the loading arm.

The pairs 5, 10; 6, 11; 7, 12; 8, 13; 9, 14 delimit drafting zones I, II, III, IV. In drafting zones II and IV, apron guides are arranged which are each formed of a bottom apron 15, 16 which winds around the bottom roller 6, 8 as well as of a top apron 17, 18 which winds around the pressure rollers 11, 13. The bottom rollers 5, 7, 9 have a ribbing. Bottom rollers 6, 8, around which bottom aprons 15, 16 are wound, are provided with a diagonal knurling.

The coverings of the top rollers 10, 12, 14 as well as the width of the top aprons 17, 18 (as well as also of the bottom aprons 15, 16) determine the respective working width B1, B2, B3, B4, B5 of the individual pairs of rollers. In the shown drafting unit 1, the working widths B1 to B5, in the travel direction of the sliver 4, are reduced in two steps between the inlet 2 and the outlet 3. The pressure roller 10 at the inlet side which, together with the pertaining bottom roller 5, can be adjusted in the direction of the arrows B-C for changing the zone width of drafting zone I, has the largest axial length, i.e., the largest working width. The next drafting zone II contains an apron guide so that the apron width of the bottom apron 15 and of the top apron 17 determine the working width B2. This working width B2 is selected such that it corresponds essentially to the working width B1 of the top roller 10. The axial length of the top roller 12 delimiting the length of the drafting zone II in moving direction of the sliver 4 is reduced to working width B3. The next drafting zone III is again delimited by a bottom roller 8 and a pressure roller 13 which have an apron guide. The apron width of this apron guide is selected such that the working width B4 corresponds essentially to the working width B3, i.e., to the axial length of the covering of the pressure roller 12. The pair 9, 14 of delivery rollers delimiting drafting zone IV has a working width B5 which is reduced again and is determined by the axial length of the top roller 14. The pairs of rollers are arranged such that they form nip lines (a, b, c, d, e) situated in a common plane, of which, for the adaptation to a fiber material, the nip line (a) can be adjusted between the shown position and position (a'). The zone width of this drafting zone I can be adjusted between 48 mm and 60 mm. Drafting zones II, III each have a zone length of approximately 50 mm, and drafting zone IV has a length of approximately 46 mm. Drafting unit 1 is suitable for a processing of slivers of Nm 0.20 to 0.40 with a fiber length of maximally 40 mm. Drafting unit 1 is further designed for a yarn count range of from Nm 40 to Nm 130, with the main application range of between Nm 50 and Nm 80. Drafting zone I is designed for a draft of from 1.1 to 1.3 times. Drafting zone II is designed for a draft of from 3 to 10 times; drafting zone III for a draft of from 1.2 to 1.3 times; and drafting zone IV for a draft of from 15 to 30 times. The diameters of the bottom rollers 5, 6, 7, 8, the ribbed or diagonally knurled length of which is slightly larger than the working widths B1, B2, B3, B4, have a diameter (Du) of approximately 25 mm. If necessary, the bottom rollers 6, 8 around which the bottom aprons 15, 16 are wound may be reduced by the thickness of the bottom aprons 15, 16.

The pressure rollers 10, 11, 12, 13 assigned to the bottom rollers 5, 6, 7, 8 have a diameter (Do) of between 24 mm and 28 mm, in which case, here also, if required, a reduction by the thickness of the top aprons 17, 18 may be provided. The diameters ($d_U$) and ($d_O$) of the bottom roller 9 and of the pressure roller 10 are clearly reduced in comparison to the other diameters. As a result, it is possible to extend the aprons 16, 18 relatively closely to the nip line of each pair of rollers 9, 14. The bottom roller 9 will have a diameter ($d_U$) of approximately 20 mm. The diameter ($d_O$) of the pressure roller 14 is set to be 20 mm to 24 mm.

In the case of the selected fiber material, working widths B1, B2 measure approximately 40 mm; working widths B3, B4 approximately 30 mm; and working width B5 approximately 20 mm. In this case, only the axial length of the pressure roller 14 is reduced at the pair 9, 14 of delivery rollers. In the case of this drafting unit, preferably approximately 80N are provided as loading forces for pressure rollers 10 and 12 and approximately 60N for pressure rollers 11, 13 and 14.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A high-draft drafting unit for a spinning machine having several drafting zones which are each delimited by two pairs of rollers formed of pressure rollers and bottom rollers and of which at least one is equipped with an apron assembly comprising a top apron and a bottom apron, the axial length of coverings of the pressure rollers and the apron width determining the respective working width of the pairs of rollers transversely to the moving direction of a sliver, wherein the working width in the travel direction of the sliver, is reduced in at least one step by reducing the axial length of the working widths of the pressure rollers and aprons following in comparison to the preceding drafting zones.

2. A high-draft drafting unit according to claim 1, wherein four drafting zones are provided and wherein at least one drafting zone; containing an apron guide is delimited by a pair of rollers having a reduced working width in the travel direction of the sliver.

3. A high-draft drafting unit according to claim 1, wherein a first and a third of the drafting zones are without an apron and are each delimited by respective pairs of rollers with at least approximately the same working width.

4. A high-draft drafting unit according to claim 1, wherein the pressure roller and the bottom roller of the pair of rollers delimiting a fourth drafting zone which is last in the travel direction of the sliver have a smaller diameter than the preceding pairs of rollers.

5. A high-draft drafting unit according to claim 2, wherein the pressure roller and the bottom roller of the pair of rollers delimiting a fourth drafting zone which is last in the travel direction of the sliver have a smaller diameter than the preceding pairs of rollers.

6. A high-draft drafting unit according to claim 3, wherein the pressure roller and the bottom roller of the pair of rollers delimiting a fourth drafting zone which is last in the travel direction of the sliver have a smaller diameter than the preceding pairs of rollers.

7. A high-draft drafting unit according to claim 1, wherein profiled areas of the bottom rollers are longer than the axial length of the coverings of the pertaining pressure rollers.

8. A high-draft drafting unit according to claim 1, wherein the axial length of the covering of the pressure roller which is part of the pair of feeding rollers measures 40 mm, and the axial length of the covering of the pressure roller which is of the pair of delivery rollers measures 20 mm.

9. A high-draft drafting unit according to claim 1, wherein the apron width of an apron assembly which is first in travel direction of the sliver measures 40 mm, and the apron width of a following apron assembly measures 30 mm.

10. A high-draft drafting unit according to claim 2, wherein a first and a third of the drafting zones are without an apron assembly and are each delimited by respective pairs of rollers with at least approximately the same working width.

11. A high-draft drafting unit according to claim 1, wherein the working width of a first of the drafting zones is adjustable between 48 mm and 60 mm.

12. A high-draft drafting unit according to claim 11, wherein the working width of a second of the drafting zones is smaller than 60 mm.

13. A high-draft drafting unit according to claim 11, wherein the working width of a fourth of the drafting zones is smaller than 40 mm.

14. A high-draft drafting unit according to claim 12, wherein the working width of a fourth of the drafting zones is smaller than 40 mm.

15. A drafting unit for drafting textile sliver for a spinning machine or the like, comprising:

a plurality of drafting zones which each include a pressure roller and a driven roller facing the pressure roller and sliver engaging means disposed along the axial length of the rollers to thereby determine the working width of the respective drafting zones, wherein the working width of at least one of the drafting zones is reduced in comparison to a next preceding one of the drafting zones along a sliver travel path through the plurality of drafting zones.

16. A drafting unit according to claim 15, wherein at least one of the drafting zones includes an apron around its pressure roller which serves as the sliver engaging means.

17. A drafting unit according to claim 15, wherein at least three drafting zones are provided.

18. A drafting unit according to claim 16, wherein at least three drafting zones are provided.

19. A drafting unit according to claim 15, wherein at least four drafting zones are provided.

20. A drafting unit according to claim 19, wherein at least two of said drafting zones include an apron around their respective pressure rollers which serves as the sliver engaging means.

21. A drafting unit according to claim 15, wherein the sliver engaging means of at lest one of the pressure rollers is a covering of elastic material surrounding the respective pressure roller.

22. A drafting unit according to claim 16, wherein the sliver engaging means of at lest one of the pressure rollers is a covering of elastic material surrounding the respective pressure roller.

23. A drafting unit according to claim 20, wherein the sliver engaging means of at lest one of the pressure rollers is a covering of elastic material surrounding the respective pressure roller.

* * * * *